United States Patent [19]

Carney

[11] 4,344,811

[45] Aug. 17, 1982

[54] BODY POSITIONING AND DRIVING APPARATUS

[75] Inventor: James E. Carney, Santa Cruz, Calif.

[73] Assignee: Caterpillar Tractor Co., Peoria, Ill.

[21] Appl. No.: 262,073

[22] Filed: Jul. 14, 1980

[51] Int. Cl.[3] ..... B29H 17/32

[52] U.S. Cl. ..... 156/397; 156/422; 242/4 R; 242/4 B; 242/4 C

[58] Field of Search ..... 156/136, 422, 425, 430, 156/432, 397; 242/4 R, 4 B, 4 C

[56] References Cited

U.S. PATENT DOCUMENTS 3,303,059 5/1968 Fahrbach ..... 242/4 C 3,458,146 7/1969 Warner ..... 242/4 C

*Primary Examiner*—David A. Simmons

*Attorney, Agent, or Firm*—Wegner, Stellman, McCord, Wood & Dalton

[57] ABSTRACT

An apparatus (10) is provided for positioning an driving a toroidal body (11), such as a sand core or the like, during the building of portions of the body. The apparatus (10) includes a height adjusting mechanism (16) for raising the horizontal mid-circumferential plane (A',A") of the body so that it will intersect the rotational center (A) of a shuttle (15) which rotates in a plane transverse to the mid-circumferential plane of body (11). The apparatus (10) includes a centering and driving mechanism (17) which includes idler roller devices (18,20) and a drive roller device (22) whereby the body is positioned and driven with the rotational center (A) of the shuttle (15) lying not only on the horizontal mid-circumferential plane (A',A") of the body, but also coinciding with the center of a cross section of the body formed by a plane of the shuttle (15). The apparatus (10) has a carrier roller aligning mechanism (21) that aligns the longitudinal axes of a plurality of carrier rollers (23,24) to intersect with the rotational axis (B,B') of the body to avoid abrasion of the body. The apparatus has a signal turret mechanism (25) with turrets (26,28) having prepositioned proximity switches (189,215), one of which is actuated so that a flag (220) on the body will signal the starting and stopping of the rotation of the shuttle (15) when the flag (220) passes the actuated proximity switch.

21 Claims, 18 Drawing Figures

FIG. 7
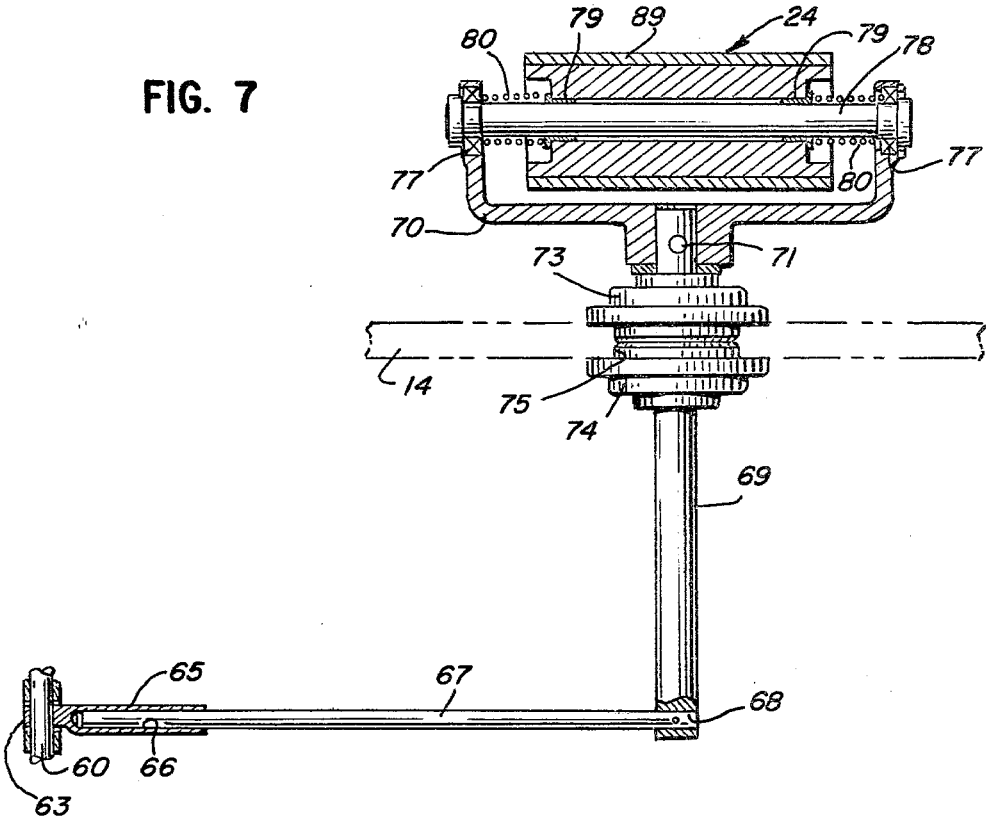
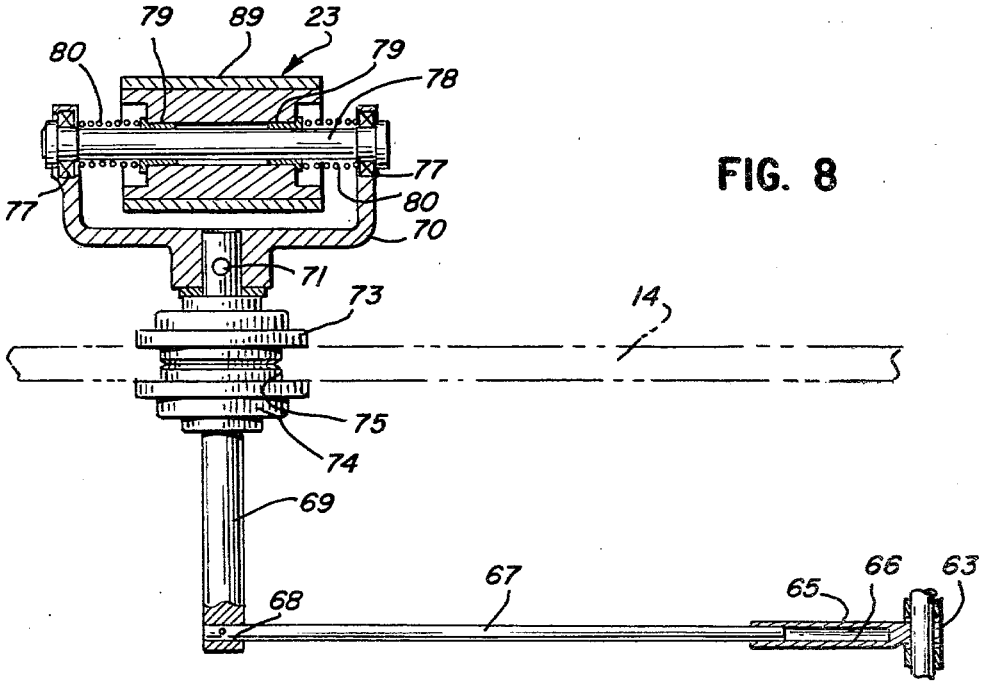
FIG. 8

115
118
18
126
125
108
120
117
116
131'
101
130
131
101
100
104
107
105
106

106
101
10
131
11
125
102
130
103
131'
18
124
126
123
12
129
128
112
10
121
108
109
12
127
111
110
115
118
11
23
23

111
109
115
119
114
122
118
125
117
123
126
128
119
108
120
109
116
101
102
101
100
103
104
106
99
105
107
14

111
121
112
109
127
115
113
110
114
108
116
109

BODY POSITIONING AND DRIVING APPARATUS

DESCRIPTION

1. Technical Field

This invention relates to a manufacturing apparatus and, more particularly, to a positioning and driving apparatus for use with any one of a plurality of toroidal bodies having differing diameters and profiles.

2. Background Art

In current body wrapping apparatus, such as tape wrapping or cable wrapping on a sand core having a toroidal shape, each body of a particular diameter and/or particular cross-sectional configuration requires a separate apparatus.

The shuttle is rotated in a plane transverse to the plane of rotation of the body and applies elongate material or cable to the body in a helical or spiral pattern. The core or body is positioned on the apparatus with the mid-circumferential plane of the core or body lying vertically and with the plane of the shuttle lying horizontally and intersecting and encircling said core as cable or tape is applied by the shuttle to the core.

Rollers support the core or body for rotation of the body in said mid-circumferential plane and include provisions for adjusting for the increase in the size of the body as cable or tape is applied to the core or body. Lack of close attention by an operator could misposition the body relative to the shuttle resulting in less than the intended quality of wrapping of the body.

Rotation of the body in one plane and rotation of the shuttle in a plane transverse thereto is started, whereupon the body is wrapped. At the conclusion of the wrapping operation, the rotation of the body and of the shuttle are stopped. The starting and stopping requires continual operator attendance with the resulting increase in costs of the finished product.

One prior core wrapping machine of the above described type is shown and described in U.S. Pat. No. 3,864,188 to Charles E. Grawey et al, issued Feb. 4, 1975, and assigned to the assignee of the present application. The machine of the Grawey et al patent supports a toroidal body for rotation in a vertical plane with a shuttle encircling the body and applying a cable or tape to the body as the shuttle rotates in a horizontal plane about the body as the body moves past the shuttle station. The machine has a bogey system which adjusts for the slight increase in body size as the cable or tape is applied to the body. A cam and follower are provided for each particular cross-sectional shape of the body. The machine does not contemplate different basic sizes and shapes of bodies.

The present invention is directed to overcoming one or more of the problems as set forth above.

DISCLOSURE OF INVENTION

An apparatus having a generally horizontally disposed table supports a horizontally disposed toroidal body for rotational movement relative to a vertically disposed rotatably driven shuttle for wrapping a continuous cable or continuous strip of material about the toroidal body in a generally spiral or helical pattern. The apparatus has a height adjusting mechanism for the table which will position the toroidal body carried by the table at the optimum wrapping position relative to the shuttle.

The diameter and cross-sectional size of the toroidal body, when punched into a programmed computer control, will provide the requisite signals to activate proximity switches on a pair of vertically oriented centering idler roller assemblies, carried by the support table, which assemblies are positioned to locate the vertical rotational axis of the body at a predetermined location as the body rests on the table.

A driving mechanism in co-operation with the centering idler roller assemblies will pivot into contact with the body to urge the body against the centering idler roller assemblies. The driving mechanism includes a drive roller which will rotate the body in a horizontal plane parallel to the support table.

Once again, the diameter and cross-sectional size of the body when fed to the computer control will result in a signal to appropriate proximity switches to activate a carrier roller aligning mechanism which will adjust the orientation of a plurality of carrier rollers that support the toroidal body on the table so that the horizontal axis of each roller is oriented to intersect at the rotational axis of the body.

Lastly, when the diameter and cross-sectional size of the body is fed to the computer control, a signal from the computer will control the movement of one of two turret mechanisms to pivot the selected turret into a location to align a selected proximity switch of the selected turret in the path of the flag plugs carried by the toroidal body. The flag plugs act first, as a position start member so that the apparatus will start rotation of the shuttle about the body and second, as a position stop member so that the rotation of the body and the shuttle may be stopped when the wrapping or cable laying is completed.

BRIEF DESCRIPTION OF DRAWINGS

FIG. 7 is an enlarged partial cross-sectional view taken along the line 7—7 of FIG. 5;

FIG. 8 is an enlarged partial cross-sectional view taken along the line 8—8 of FIG. 5;

BEST MODE FOR CARRYING OUT THE INVENTION

Figure 1:
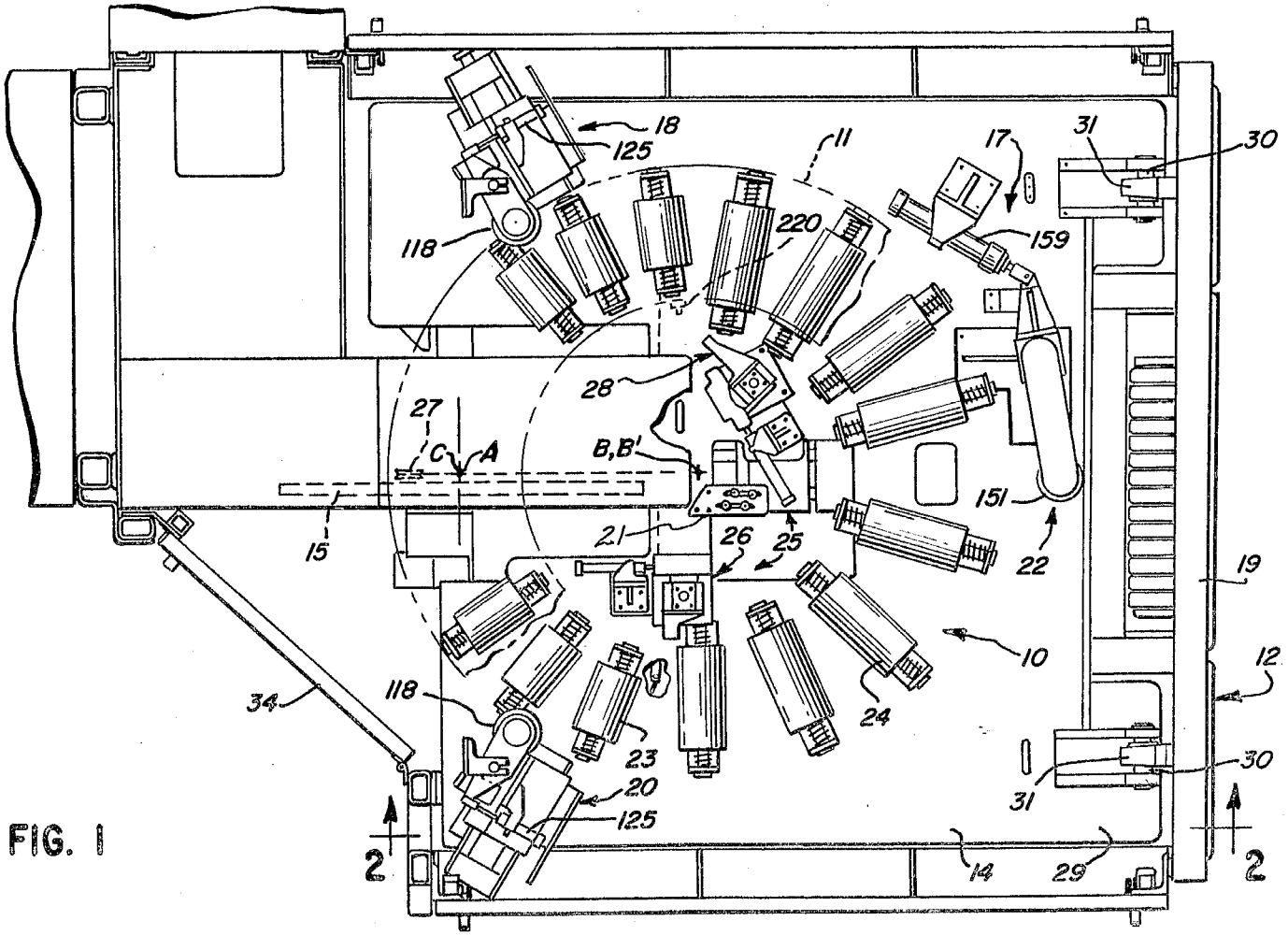
FIG. 1 is a top plan view of a body-wrapping apparatus showing one embodiment of the present invention with the shuttle and toroidal body shown in phantom.

Referring to FIG. 1 of the drawings, a plan view of a body-wrapping apparatus 10 is illustrated enclosed in a cabinet 12 and includes a support table 14 carrying a plurality of carrier rollers 23,24 for supporting a body 11, shown in phantom, such as a toroidal core, in a generally horizontal plane for rotation about a vertical or rotational axis B,B' of the body 11. A shuttle 15, shown in phantom, is mounted in a plane substantially transverse to the plane of the support table 14 and encircles the body 11 so as to apply an elongate material, such as cable or tape 13 (FIG. 5), to the body 11 as the body rotates through the rotating shuttle 15. The support and drive for the shuttle 15 is fixed relative to a frame 19 so that a rotational center of the shuttle 15 will be a substantially fixed point identified by the letter "A" in the horizontal plane of FIG. 5 and by the same letter "A" in the vertical plane of FIG. 6A. The rotational center "A" of the shuttle 15 is defined as the point about which the applicator or guide roller 27 (FIG. 1 and FIG. 6A) orbits in response to rotation of the shuttle 15.

The body-wrapping apparatus 10 is controlled by a control unit, such as an Allen Bradley #1750 Programmable Control. The control unit synthesizes the signals provided by the various proximity switches (to be identified hereinafter) and, in response thereto, transmits a signal to one or more operating components to start or to stop the operation performed by said operating component. In some cases, the operating component is driven by electricity, such as the electric motor, such that the signal from the control unit will close a switch to start the motor. In other cases, the operating component is driven by other means, such as air, so that the signal from the control unit will operate a control means to admit to or to exhaust air from an air cylinder, whereupon an operating component connected to the air cylinder will be actuated. The actuation may be either a movement to, a movement from, or a movement to an intermediate position from an "at rest" position. The apparatus 10 includes the support table 14 which has a height-adjusting mechanism 16 (FIGS. 2–4) for raising and lowering the support table 14, and the carrier rollers 23,24 carried by the support table 14, relative to the shuttle 15, and has a centering and driving mechanism 17 (FIGS. 1, 10–14) which includes a pair of idler roller devices 18,20 for centering the rotational axis (B,B') of the body 11 relative to the rotational center "A" of the shuttle 15 so that the body 11 is centered within the shuttle 15. The driving portion of the centering and driving mechanism 17 is a drive roller device 22 (FIGS. 1,13,14) which urges the body 11 against the idler roller devices 18,20 of the mechanism 17 and, when actuated, will rotate the body 11 in the plane of the support table 14.

The body-wrapping apparatus 10 also includes a carrier roller aligning mechanism 21 (FIGS. 1,5,6,7,8) for orienting the axes of the plurality of carrier rollers 23,24 on the support table 14 so that the axes of the carrier rollers 23,24 will intersect at the rotational axis or vertical centerline B,B' of the body 11.

Finally, the body-wrapping apparatus 10 includes a signal turret mechanism 25 which comprises a pair of turrets 26 and 28 (FIGS. 1, 15–17), only one of which is in operating position at any one time. The diameter and the cross-sectional size of the body 11 is fed to the computer whereupon the computer will signal movement of the appropriate turret 26 or 28 into operative position and will energize a selected one of several vertically spaced proximity switches (FIGS. 15–17) carried by said turret. A flag (FIGS. 15,17) carried by the rotating body will sweep past the selected switch to signal the start of rotation of the shuttle 15 and, subsequently, to signal the concurrent shutdown of rotation of the body 11 and of rotation of the shuttle 15.

Referring to FIGS. 1 through 4, the heightadjusting mechanism 16 for raising and lowering the support table 14 is shown and has one end portion 29 (FIG. 2) of the support table 14 mounted for pivotal movement relative to a base or frame 19 on the cabinet 12 by means of pins 30 and clevis brackets 31. The outboard end portion 33 of the support table 14, which portion 33 is diametrically opposite the pivoted end portion 29, is connected to a pair of spaced apart actuators 35 which have extendible members 39 pivotally connected through clevis brackets 36 and pins 38 to the underside of the support table 14 with the extendible members 39 being encased in a protective collapsible sleeve 37. The extendible members 39 may be a threaded element operatively associated with a driving nut enclosed in the housing 49. The housing 49 is rigidly connected to a hollow tube or can 44 which is pivotally mounted to a U-shaped mounting bracket 46 bolted to a crossbar 32, shown in phantom in FIG. 2, of the base or frame 19. The typical actuator 35, whereby the extendible member 39 is extended or retracted relative to the driving nut in the housing 49, is known as a JACTUATOR LINEAR ACTUATOR, which is a trademark of Puff-Norton, and identified as Model No. CCN28021-3. The lower end portion of the extendible member 39 telescopes in the tube or can 44 as it is extended and retracted.

Figures 2, 3, 4:
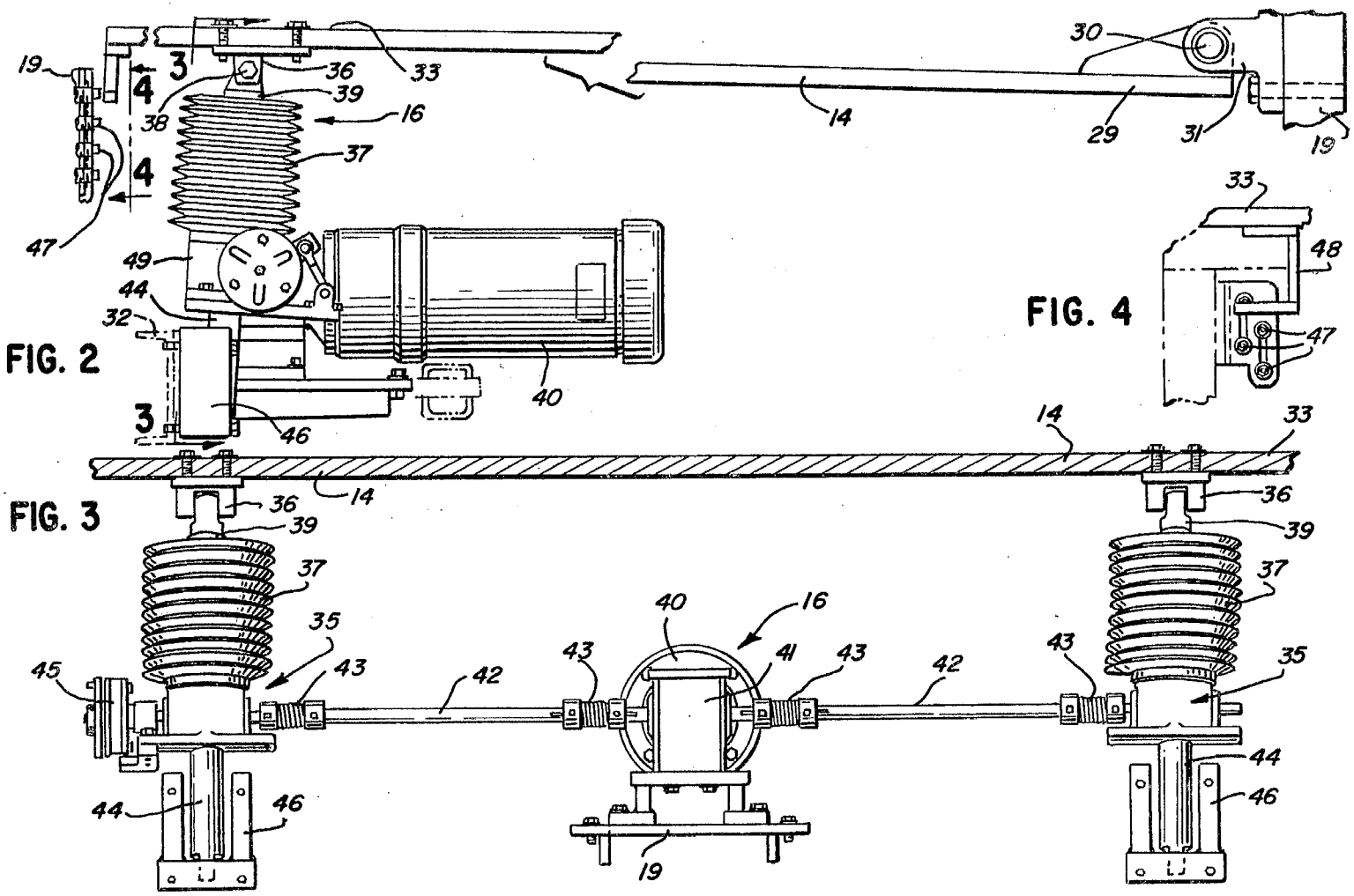
FIG. 2 is a partial cross-section view taken along the line 2—2 of FIG. 1 showing the table elevating mechanism with parts broken away.
FIG. 3 is a cross-sectional view taken along the line 3—3 of FIG. 2 with parts broken away.
FIG. 4 is a partial cross-sectional view taken along the line 4—4 of FIG. 2.

As shown in FIGS. 2 and 3, a motor 40 drives, through a gearbox 41 mounted on the frame 19, a pair of outwardly extending, rotatable drive rods 42 which are connected through flexible couplings 43 to the driving nuts in the housings 49. A magnetic brake 45 is connected to the outboard end of one drive rod 42 and is electrically tied in to the motor 40, such that when the motor 40 is off, the brake 45 will actuate to lock the rods 42 against rotation. The brake 45 will also lock the actuators 35 and prevent further movement, up or down, of the extendible members 39 and of the outer end portion of the support table 14.

FIGS. 2 and 4 show a plurality of vertically spaced apart proximity switches 47 mounted on one end portion of the frame 19, with each proximity switch 47 being electrically connected to the preprogrammed control unit.

Downwardly depending from the outboard end portion 33 of the support table 14 (FIGS. 2,4) is an L-shaped ferrous bar 48 which is positioned to pass vertically in closely spaced relationship to the plurality of stationary proximity switches 47 as the support table 14 is raised. It should be understood that any form of actuating mechanism for raising and lowering the outboard end portion 33 of the support table 14 is acceptable as long as it is positive and accurate in positioning the mid-circumferential plane, designated A', A" in FIG. 6A, of the body 11 at the proper height. In the illustrated embodiment, the control unit is preprogrammed so that for each body size to be wrapped, a particular one of the proximity switches 47 will be actuated and a switch to the motor 40 will be closed, whereupon the motor 40 will operate to extend the extendible members 39 of the actuators 35 to raise the outboard end portion 33 of the support table 14 about the pivots 30 on the frame 19. When the ferrous bar 48 aligns with the actuated proximity switch 47, the proximity switch 47 will signal the control unit to transmit a signal to shut off the motor 40 and to activate the magnetic brake 45 to lock the support table 14 in the selected position.

A signal will be sent to the control unit either upon completion of the wrapping cycle of the body, or upon opening an electrical interlock on a door 34 into the cabinet 12. The signal will cause the control unit to signal the switch to the motor 40 to turn the motor 40 "on" for lowering the support table 14 to the lowermost, at rest, position. The control unit is programmed to lower the support table 14 to the lowermost position anytime the door 34 is opened; for instance, when a wrapping or cable breaks or when other breakdowns occur. The movement of the support table 14 to the proper height for wrapping, or the like, is either none at all, as when the tire size dictates that the lowermost position of the support table 14 is the proper height for wrapping, or is in an upward direction to the proper height for wrapping.

The purpose for raising the outboard end portion 33 of the support table 14 is to intersect the mid-circumferential plane A',A" of the body 11 with the rotational center "A" of the shuttle 15. As different sized bodies 11 have different diameters and different cross-sectional sizes, the control unit is programmed for a full range of body sizes. Thus, when the particular body size is fed to the control unit and the door 34 is closed, a signal from the control unit will actuate not only the selected proximity switch 47, but also the switch to operate the motor 40 to move the support table 14 until the mid-circumferential plane of the body intersects the rotational center "A" of the shuttle 15.

Continuing, FIGS. 5–8 show the carrier roller aligning mechanism 21 for orienting the plurality of carrier rollers 23,24 carried by the support table 14 so that the longitudinal axes of each carrier roller 23,24 will intersect at the rotational axis or vertical centerline B,B' of the body 11. In this way, the side wall of the body 11 positioned on the carrier rollers 23,24 will not be scuffed or abraded due to relative motion between the rollers 23,24 and the side wall of the body. Two different sized carrier rollers 23,24 are rotatably mounted on the support table 14 with rollers 24 mounted closer to the pivoted end portion 29 of the support table 14 and having a greater longitudinal length to accommodate for more horizontal movement of the body 11 relative to the support table 14 at that portion of the support table 14. The shorter carrier rollers 23 are on the outboard end portion 33 of the support table 14.

Returning to FIG. 6A, it is desirable to have the fixed rotational center "A" of the shuttle 15 lie in the mid-circumferential plane A',A" of the body, and to have the rotational center "A" coincide with the geometric center "C" of a cross section of the body where the vertical plane containing the rotational axis B,B' and the rotational center "A" intersects the body 11. All bodies, no matter of what size that are positioned on the rollers 23,24, will be raised, as described above, and will be centered, as will be described hereinafter, with the rotational center "A" of the shuttle 15 and geometric center "C" of the cross section of the body superimposed on each other. From the above, it will be seen that that portion of the body near the shuttle 15 will receive relatively little transverse movement with respect to the rotational center "A" and, thus, the short lengths of carrier rollers 23, while that portion of the body moves remote from the center "A" will receive more transverse movement with respect to the rotational center "A" in aligning geometric center "C" therewith and, thus, the longer lengths of the carrier rollers 24.

Figure 5:
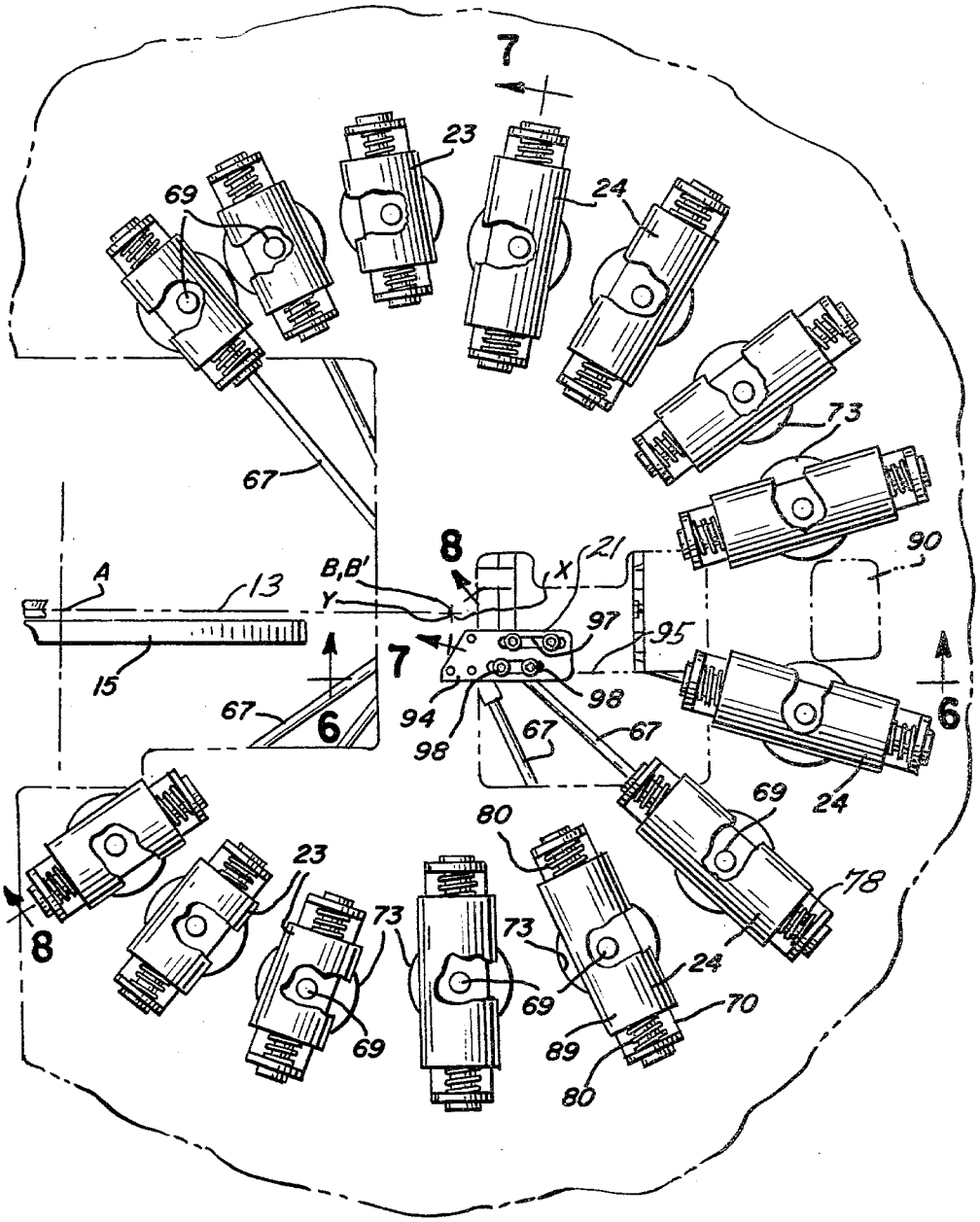
FIG. 5 is an enlarged partial top plan view of the carrier rollers orienting mechanism.

As shown in FIGS. 7 and 8, each roller 23,24 has a U-shaped bracket 70 of appropriate length with an axle 78 extending through the rollers 23,24 and between bearings 77 in the legs of the bracket 70. A pair of compression springs 80 encircle the axle 78 with each spring 80 bearing against a bushing 79 in the opposite ends of the rollers 23,24 to urge the rollers 23,24 to the midportion of the axle 78 and bracket 70. The bushings 79 and bearings 77 permit each roller 23,24 to both slide and roll freely relative to the bracket 70. A pivot rod 69 is keyed by a pin 71 to the midportion of each bracket 70 and extends downwardly through mating bushings 73,74 seated in apertures 75 in the support table 14. As seen in FIG. 5, the centers of the pivot rods 69 of carrier rollers 24 form one semicircle and the centers of the apertures 75 of carrier rollers 23 from another larger diametered semicircle with both semicircles having a common center.

Figures 6, 6A:
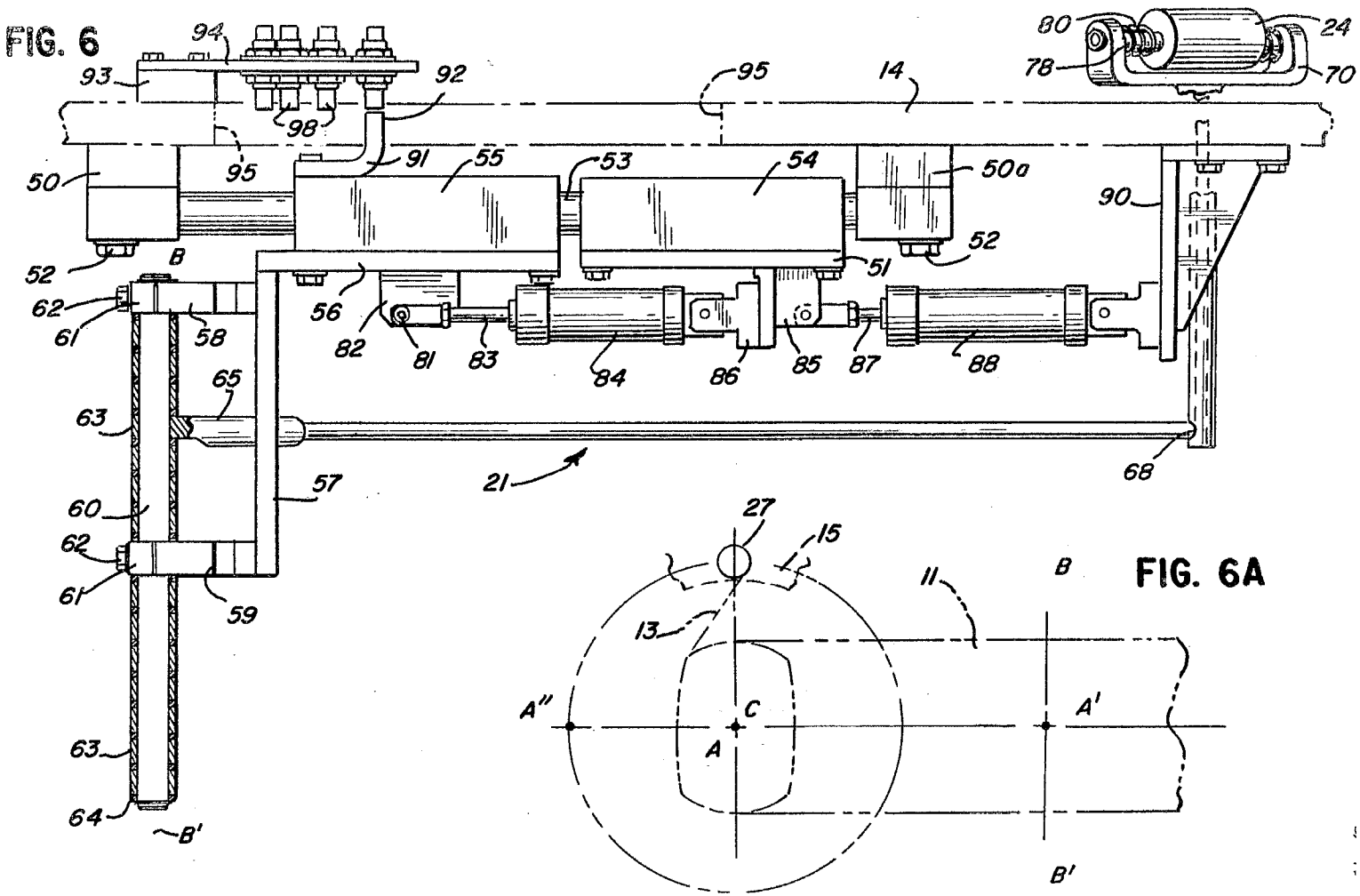
FIG. 6 is a cross-sectional view taken along the line 6—6 of FIG. 5.
FIG. 6A is a diagrammatic view of the relative location of some points, centerlines and planes of some of the parts of the invention.

To accomplish the radial orientation of the longitudinal axes of the carrier rollers 23,24, reference is made to FIGS. 1 and 5 through 8 wherein, referring particularly to FIG. 6, a pair of brackets 50 and **50*a* are secured by bolts 52 to the undersurface of the support table 14 with a pair of parallel tracks 53 extending between the brackets 50 and 50*a*. Two separate slides or blocks 54 and 55 ride on the tracks 53. Block 55 has a plate 56 bolted to the undersurface thereof, which plate 56 supports a downwardly depending frame 57 from which a pair of vertically spaced apart, horizontally disposed arms 58,59 extend. A vertically disposed cylindrically-shaped axle 60 is secured to the outboard ends of the arms 58 and 59 by a pair of caps 61 bolted at 62 to said arms. A plurality of bearing sleeves 63 encircle the axle 60 and are juxtaposed, one on top of the other, throughout the length of the axle 60 with some sleeves above and some sleeves below the support arm 59. A washer 64 is secured against the lowermost end of the axle 60 for supporting the sleeves 63 below the arm 59. Each sleeve 63 has a transversely extending hollow coupling 65 either integrally formed or permanently secured to the outside wall of each sleeve 63. There is one sleeve 63 and coupling 65 for each carrier roller 23 and 24 on the support table 14. Slidably engaging in an aperture 66, see FIGS. 7 and 8, of each coupling 65 is an extension rod 67 which has its outer end portion pinned in an aperture 68 at the lower extremity of one of the pivot rods 69 extending from each roller 23,24. Movement of each rod 67 about the axis of an attached rod 69 will rotate the rod 69 about the axis of said rod 69 and will likewise rotate the brackets 70 and rollers 23,24 about said axis of the rod 69**.

As FIGS. 5 and 7 show, the axis of each axle 78 of each carrier roller 23,24 lies parallel to the axis of the rod 67 radiating from the axle 60 so that any movement of the rods 67 about the axis of the pivot rod 69 will slavishly move the axis of the carrier rollers 23,24 connected to said rod the same amount. The vertical longitudinal axis of the axle 60 is the center of the two semicircles subscribed by the centers of the rods 69 from the carrier rollers 23,24 with the lengths of the axes of the extension rods 67, extending from axle 60 to the pivot rods 69, being the radii of the semicircles. As will become apparent hereinafter, the vertical axis of the axle 60 coincides with the rotational axis B,B' of the body 11 being wrapped and they will both be referred to hereinafter as rotational axes B,B'.

Downwardly depending from the block 55 and plate 56, FIG. 6, is a bracket 82 to which is connected a clevis 81 which, in turn, is connected to the outer end of a rod 83 extending from an actuator 84. The end of the actuator 84, remote from the rod 83, is connected to a clevis 86 connected to a bracket 85 depending from the block 54 and plate 51. An actuator 88 has a rod 87 pinned to the bracket 85 with the end of the actuator remote from the rod being connected to a bracket 90 which is anchored to the undersurface of the support table 14. Actuators 84 and 88 and blocks 55 and 54 all lie along a common axis so that extension or retraction of the actuators 84 and 88 will move the blocks 54 and 55 along the tracks 53.

As FIG. 6 illustrates, a probe 91 is secured to the block 55 and has a ferrous-actuating tip 92 which extends transverse to the axis of the tracks 53. Mounted on the upper surface of the support table 14 is a spacer 93 which supports a rectangularly-shaped support 94 in overhanging relationship to a cutout 95 (FIG. 5) in the support table 14. Two elongate, substantially parallel slots 97 are formed through the support 94 with a pair of proximity switches 98 secured in each slot 97 at an appropriate location therealong. The proximity switches 98 can be adjusted along the length of their associated slot 97 and are secured at the location along the slot by lock nuts, or the like. The operative ends of the proximity switches 98 extend a uniform distance downward from the support 94 and lie along a path that is swept by the ferrous-actuating tip 92 of the probe 91 carried by the block 55.

Movement of the axle 60 (and, therefore, the rotational axis B,B') to the left or to the right, FIG. 6 will cause the extension rods 67 to pivot, in varying degrees, about the axis of the axle 60 as the rods 67 slide in or out of the apertures 66 in the couplings 65. As the rods 67 re-orient to a new location of the axis B,B' of the axle 60, the pivot rods 69 will pivot and will turn the carrier rollers 23,24 an equal amount so that the longitudinal axis of each carrier roller 23,24, when extended, will still pass through the vertical axis B,B' of the axle 60.

As viewed particularly in FIG. 5, to move the axis B,B' of the axle 60 from the point "X" to the point "Y", will re-orient the longitudinal axes of the carrier rollers 23,24. The carrier rollers 23,24 close to the vertical plane containing the rotational axis B,B' of the axle 60 (and body 11) and the rotational center "A" of the shuttle 15, will be re-oriented a minimum amount and the rollers 23,24 substantially at right angles to said vertical plane will have a maximum amount of re-orientation.

Actuator 84 is designed to have a shorter stroke for the rod 83 than will the larger actuator 88 have for the rod 87. In this way, the various combinations of extended and retracted conditions of the rods 83 and 87 will position the vertical axis B,B' of the axle 60 at one of several predetermined positions. The predetermined positions will each have a vertical centerline B,B' which will coincide with the rotation axis B,B' of the body 11 lying on the support table 14. With the rods 83 and 87 completely retracted, the axle 60 will be in the most right-hand position as viewed in FIG. 6 with the ferrous-actuating tip 92 aligned with the right-hand most proximity switch 98. Extending rod 83 while holding rod 87 retracted will move the vertical axis B,B' and axle 60 to the left an amount sufficient to position the ferrous-actuating tip 92 in alignment with the second proximity switch 98. Complete retraction of the rod 83 and complete extension of the rod 87 will move the vertical axis B,B' and axle 60 to the left an amount sufficient to position the ferrous-actuating tip 92 with the third proximity switch 98 and, lastly, full extension of rods 83 and 87 will move the vertical axis B,B' and axle 60 to the full left-hand position with the ferrous-actuating tip 92 aligned with the leftmost proximity switch 98.

When a body size is entered in the control unit, a signal from the control unit will actuate a particular one of the proximity switches 98 and will also actuate an appropriate air cylinder control means to activate one or both of the actuators 84,88 to move the axle 60 and ferrous-actuating tip 92 until the ferrous-actuating tip 92 aligns with the actuated proximity switch 98. The proximity switch 98 will sense the tip 92 to signal the control unit to shut down the air cylinder control means and, therefore, to shut down further movement of the actuators 84,88. The movement of the axle 60 and its vertical axis B,B' will re-orient the carrier rollers 23,24 so that the axis of each carrier roller 23,24 will lie along a radius passing through the vertical axis B,B', which will also be the rotational and geometric axis B,B' of the body 11 disposed on the carrier rollers 23,24 on the support table 14. Each carrier roller 23,24 may have a rubber, or similar type material, forming a surface 89 thereon which rolls with respect to the side wall of the body 11 and may be replaced when worn. Since the axes of the rollers 23,24 will all be on a radii of the body, there will be no scuffing or abrading between the rollers 23,24 and the body.

The centering and driving mechanism 17 is shown in FIGS. 9 through 14 and is comprised of the idler roller devices 18 and 20 and the drive roller device 22 which function, first, to center the body 11 so that the rotational or vertical axis B,B' of the body 11 coincides with the vertical axis B,B' of the axle 60 and, second, to rotate the body 11 about said rotational or vertical axis B,B'. This is accomplished by a three-point contact on the outside circumference of the body 11, two points of contact being afforded by the idler roller devices 18,20 and the third point being afforded by the contact point of the drive roller device 22. The idler roller devices 18 and 20 are substantially mirror images of each other, and, accordingly, only one idler roller device will be described. For the purposes of this description, idler roller device 18 has been selected and, referring to FIGS. 9 through 12, particularly FIG. 11, a base 100 having an inverted "U" shape is secured on the top surface of the support table 14 and has a pair of upstanding brackets 101 for securing a pair of parallel tracks 102 therebetween. A block 103 is slidably mounted on the tracks 102 and has a downwardly depending bracket 104 which is connected to a clevis 107 on the outer end of a rod 105 extending from an actuator 106 mounted on a bracket 99 carried by the undersurface of the base 100.

Figure 9:
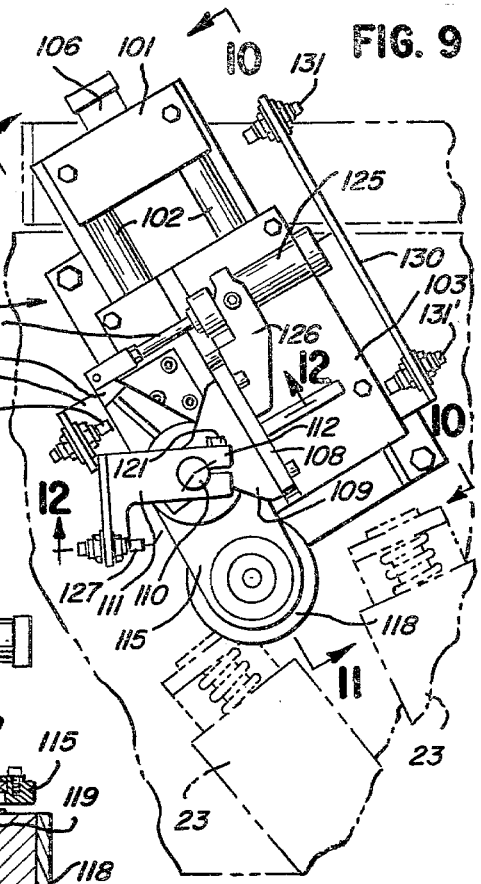
FIG. 9 is an enlarged top plan view of one idler roller centering apparatus broken away from the remainder of the table plate.
Figure 11:
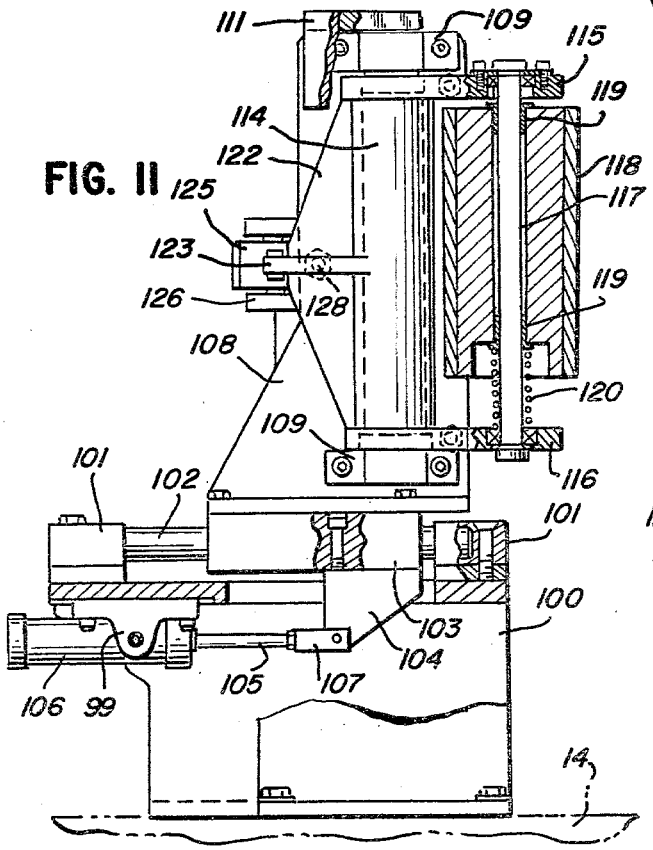
FIG. 11 is an enlarged cross-sectional view taken along the line 11—11 of FIG. 9.
Figure 12:
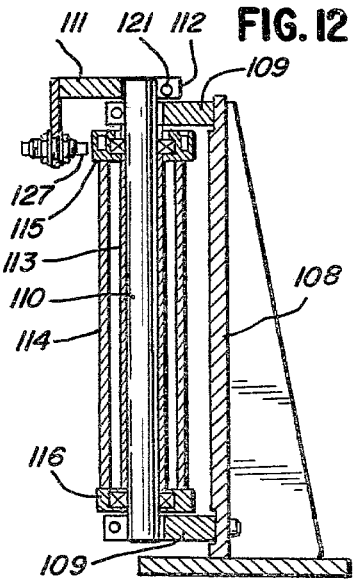
FIG. 12 is a cross-sectional view taken along the line 12—12 of FIG. 9.

A frame 108 is supported on the block 103 and extends transversely upward therefrom. A pair of vertically spaced apart holders 109 (FIG. 12) are secured to the frame 108 and to the upper and lower portions of a pivot shaft 110. As shown in FIGS. 9 and 12, a bracket 111 has a split end 112 locked by a threaded member 121 to the upper end of the pivot shaft 110 with bracket 111 supporting a proximity switch 127 with the probe of the proximity switch 127 projecting back generally toward the frame 108. As shown in FIG. 12, between the holders 109 and surrounding the pivot shaft 110 is a sleeve 113 which rotates relative to the pivot shaft 110. A sleeve 114, concentric with the sleeve 113, extends between a pair of spaced apart plates 115 and 116. As shown in FIG. 11, the plates 115 and 116 project outward from the sleeve 114 and have a pivot shaft 117 extending therebetween. Referring to FIG. 11, an idler roller 118 is rotatably mounted on the pivot shaft 117 and has a pair of shouldered bushings 119 rotatably and slidably engaging the pivot shaft 117. A spring 120 extends between lower plate 116 and one bushing 119 to urge the idler roller 118 upward relative to the plate 116. The sleeve 114 has, on the diametrically opposite side from the idler roller 118, an angled plate 122 secured thereto and extending radially from said sleeve 114 and, as shown in FIG. 9, supports an enlargement 123 which is pivotally connected to the outer end of a rod 124 extending from an actuator 125 mounted on a bifurcated bracket 126 carried by the frame 108. Actuation of the actuator 125 will extend or retract the rod 124 to pivot the sleeve 114 about the pivot shaft 110 which, in turn, will move the idler roller 118 inward or outward relative to the body 11 disposed on the carrier rollers 23 and 24 (see FIG. 1).

Figure 10:
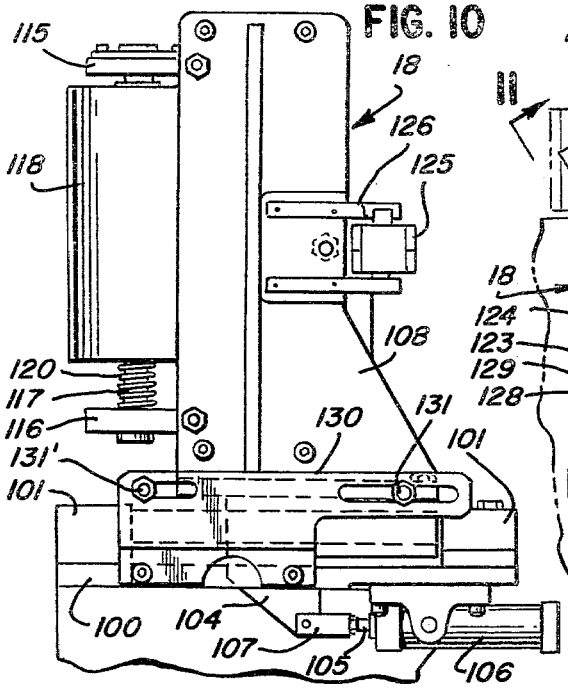
FIG. 10 is a cross-sectional view taken along the line 10—10 of FIG. 9.

A proximity switch 128, as shown in FIG. 9 and in dotted lines in FIG. 11, is mounted on a bracket 129 carried by the block 103 with the probe of the proximity switch 128 aligning with a portion of the plate 122 as the idler roller 118 is moved toward or away from its operative position. Referring now to FIGS. 9 and 10, a bracket 130 is bolted to the fixed base 100 and has a pair of horizontally spaced apart and horizontally adjustable proximity switches 131,131', the probes of which are ponitioned along the path of movement of the block 103 as said block 103 is moved by the actuator 106 from one extremity to the other along the tracks 102.

When the control unit receives the body size information, the control unit will send a signal to actuate the actuator 106 which will move the block 103 carrying the idler roller 118 from an at rest initial position, forward an amount, as viewed in FIGS. 9 and 11, depending upon the diameter of the body. The proximity switch 131' will signal the control unit that the idler roller 118 is in an extended position. The control unit will correlate the signal from switch 131' as one of several needed to signal the next operation. The control unit will also signal an appropriate valve control for actuating actuator 125 to extend the rod 124 which will pivot the sleeve 114 about the pivot shaft 110 to swing the idler roller 118 into a body-engaging position. The rod 124 will move the plate 122 into close proximity to the proximity switch 128 which will signal the control unit that the idler roller 118 is in the forward body-engaging position.

When the wrapping of the body has been completed, the control unit will signal the valve control to actuate actuator 125 to retract the rod 124 which will pivot the sleeve 114 and move the idler roller 118 out of contact with the body 11. The upper plate 115 on the sleeve 114 will approach the proximity switch 127 as the idler roller 118 is being retracted and, upon retraction, will signal the control unit that the idler roller 118 is fully retracted. The control unit will then signal the valve control to actuate actuator 106 to retract the block 103 and idler roller 118 carried thereby. The block 103 will align with the probe of proximity switch 131 to signal the control unit that the idler roller device 18 is in the at rest position. The two idler roller devices 18 and 20 operate together and, when in the forward position with the two idler rollers 118 in contact with the body 11, two points are established for centering the body 11 on the carrier rollers 23, 24 carried by the support table 14.

Figure 14:
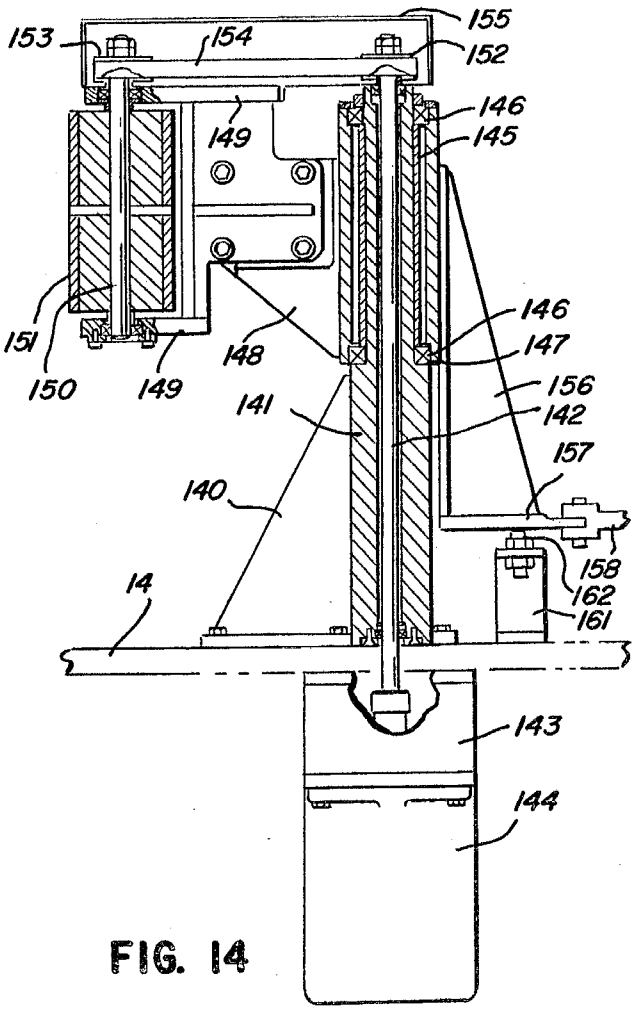
FIG. 14 is a cross-sectional view taken along the line 14–14 of FIG. 13.
Figure 13:
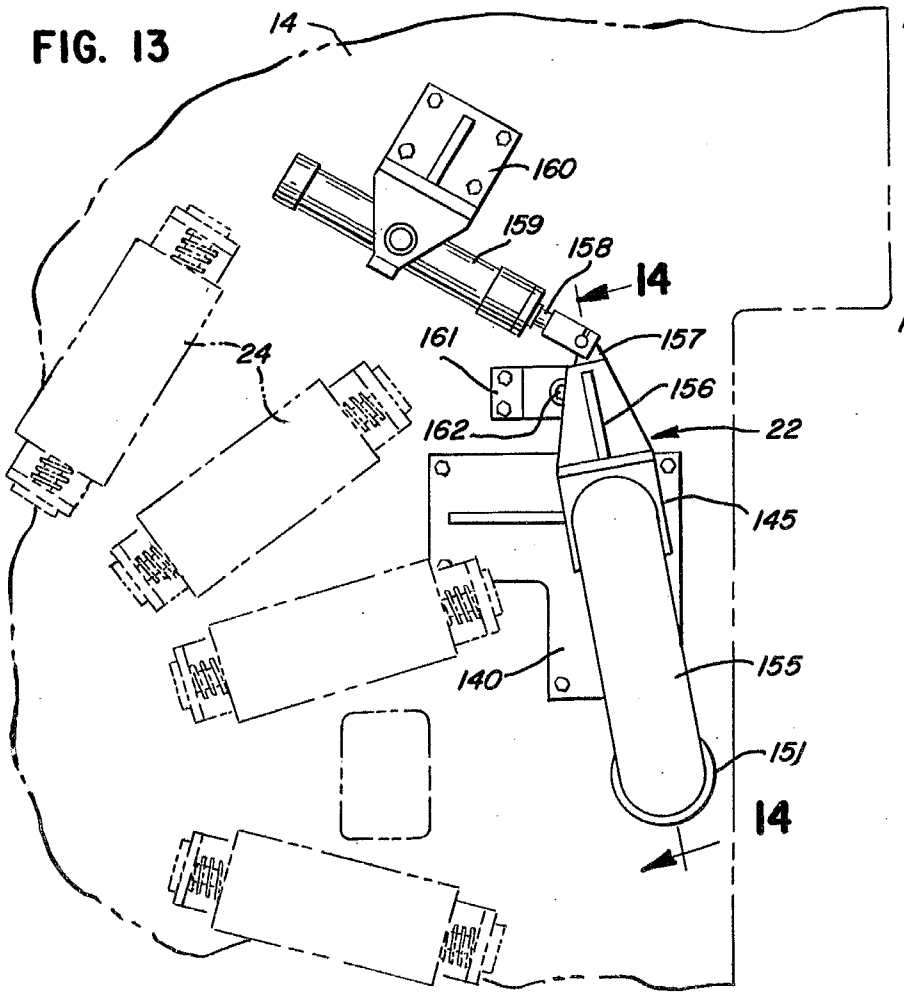
FIG. 13 is an enlarged top plan view of a driving and centering roller used with two of the idler rollers of FIG. 9 shown broken away from the table plate.

The drive roller device 22, shown in FIGS. 1, 13 and 14, includes a drive roller 151 which is brought into engagement with the circumferential surface of the body 11 to complete the centering of the body 11 and to rotate the body 11 about its rotational axis B,B'. Specifically, referring to FIG. 14, the drive roller device 22 has a bracket 140 bolted to the upper surface of the support table 14 and has a vertically extending fixed bushing 141 in which is rotatably mounted a drive shaft 142. Drive shaft 142 is driven by a motor 144 and gear system 143 mounted below the support table 14. A sleeve 145 encircles a portion of bushing 141 and extends between a pair of bearings 146, one of which is seated against a shoulder 147 on the bushing 141. A bracket 148 is secured to the sleeve 145 and projects radially outward therefrom and has a pair of vertically spaced apart portions 149 extending outwardly from the outer end thereof. A drive shaft 150 extends between the portions 149 for supporting the drive roller 151 which is keyed to said shaft 150.

A pulley 152 is keyed to the upper end of the drive shaft 142 with a pulley 153 being keyed to the upper end of the drive shaft 150. A drive belt 154 extends between the pulleys 152 and 153 to transmit drive from the motor 144 to the drive roller 151. The pulleys 152 and 153 and the drive belt 154 are encased in a closure 155. Also carried by the sleeve 145, and extending in a direction opposite to the bracket 148, is a hanging bracket 156 which has an outwardly extending horizontal plate 157 to which a rod 158, extending from an actuator 159, is connected. Actuator 159, as shown in FIG. 1 and primarily FIG. 13, is mounted on a bracket 160 carried by the support table 14. A bracket 161, secured to the support table 14, supports a proximity switch 162 with a probe in the path of travel of the plate 157. With a body horizontally disposed on the carrier rollers 23,24 on the support table 14 and the size of the body transmitted into the control unit, a signal from the control unit will actuate the actuator 159 which will drive the rod 158 forward to pivot the drive roller 151 against the body 11 to urge the body against the two idler rollers 118. The body 11 is now properly oriented in relation to the rotational or vertical axis B,B' and in relation to the rotational center "A" of the shuttle 15.

The control unit will signal the controls to activate the motor 144 which will drive the drive shaft 142 and the drive belt 154 to rotate the drive roller 151 and thereby rotate the body 11 about the rotational or vertical axis B,B' of the body. The shuttle 15 will be separately activated to wrap the body 11 as will be described hereinafter. Upon completion of the wrapping of the body 11, the control unit will signal the stopping of the motor 144 and will signal the controls to actuate the actuator 159 to pivot the drive roller 151 out of contact with the body 11. When the plate 157 is aligned with the proximity switch 162, it will signal the control unit that the actuator 159 and drive roller 151 are in the at rest position.

The signal turret mechanism 25 includes the pair of turrets 26 and 28, as shown in FIGS. 1, 15, 16 and 17, which are mounted on the support table 14 to operate within the open center portion of the toroidal body 11. Only one turret, either 26 or 28, is in operative position and operable at any one time. The turrents 26 and 28 support a predetermined number of proximity switches 189,215, one proximity switch 189 or 215 on the operative turret 26 or 28 being operative for each body size. In the illustrated form, although three proximity switches 189 and three proximity switches 215 are illustrated, it should be understood that the number of proximity switches 189,215 can be varied to conform to the number of different body sizes to be processed on the apparatus.

Figure 15:
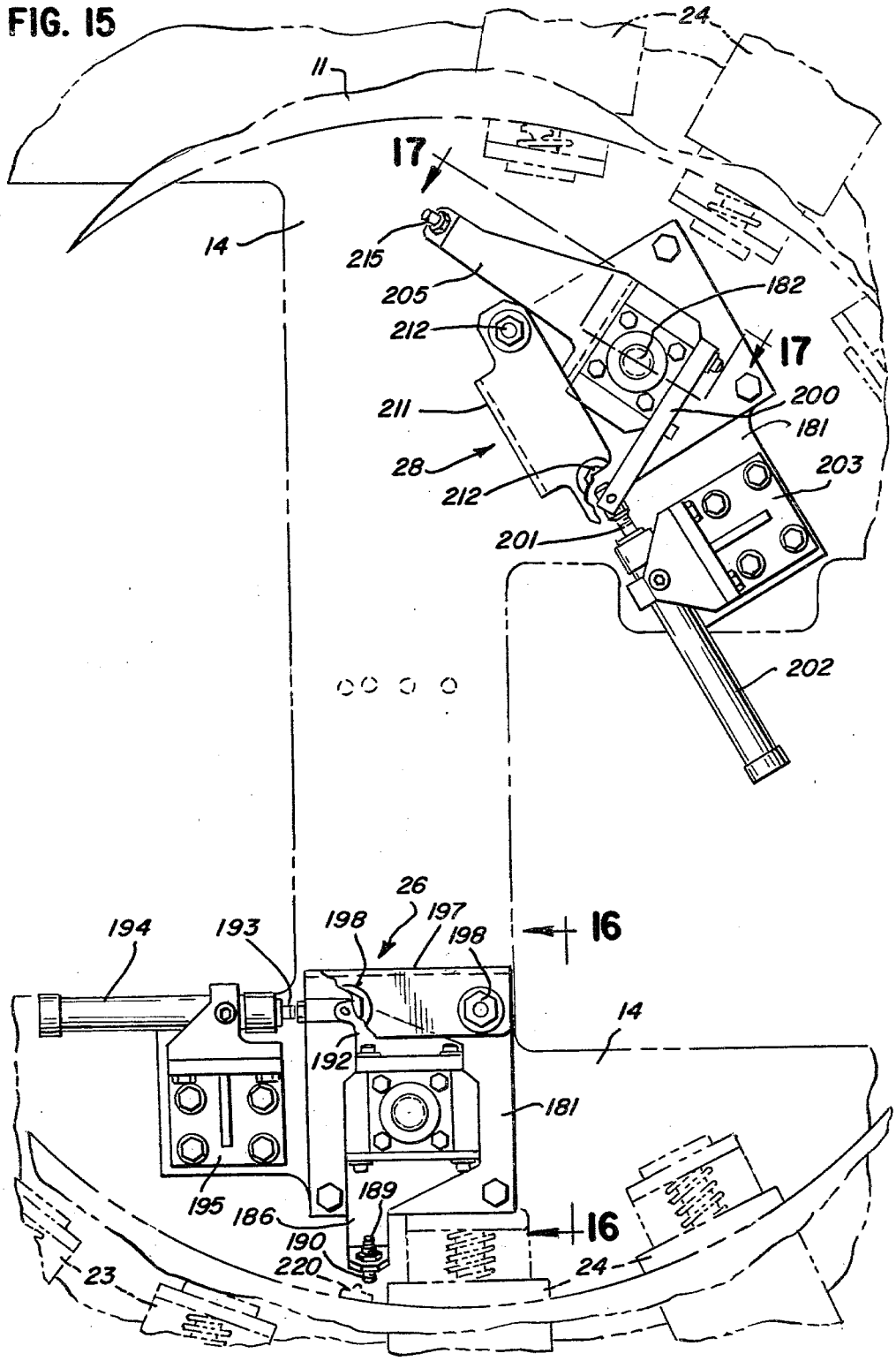
FIG. 15 is an enlarged partial top plan view of the table plate showing two diametrically opposite turrets pivotally mounted on the plate.
Figure 16:
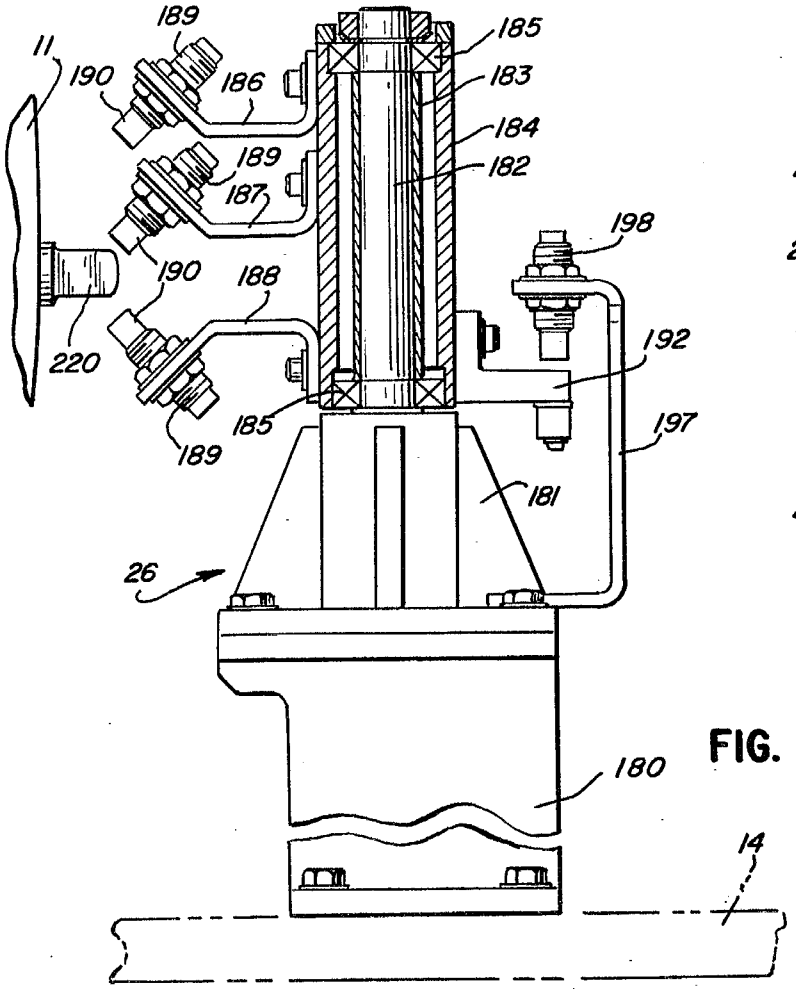
FIG. 16 is a cross-sectional view taken on the line 16–16 of FIG. 15.

In FIGS. 1 and 15, turret 26 is in the operative position, with turret 28 in the inoperative position and as shown in FIGS. 15 and 16, turret 26 has a base 180 bolted to the support table 14 with a flanged support 181 bolted on the base 180. An upwardly extending pivot shaft 182 is carried by the support 181. A pair of sleeves 183 and 184 concentrically encircle the pivot shaft 182 and have bearings 185 for rotatably mounting the sleeves 183,184 on said pivot shaft 182. Three brackets 186,187 and 188 are secured to the outer sleeve 184 with each bracket supporting a proximity switch 189 on the outer end thereof. The probe 190 of each proximity switch 189 is disposed at a different vertical height above the support table 14.

A bracket 192 is attached to the sleeve 184 on the diametrical opposite side from the brackets 186,187 and 188, to which is mounted a rod 193 extending from an actuator 194. The actuator 194 is carried by a support bracket 195 mounted on the support 181. An overhanging plate 197 is carried by the support 181 and supports a pair of spaced apart proximity switches 198 with the probes of the proximity switches 198 aligning with the path of movement of the bracket 192 on the sleeve 184.

Turret 28, shown in inoperative position in FIG. 15, has essentially the same parts as turret 26 except that bracket 192 is replaced by a bar 200 which projects in the opposite direction from the direction of bracket 192. The bar 200 is connected to the rod 201 of the actuator 202, which actuator 202 is mounted on a bracket 203 fastened to the support 181. As shown in FIGS. 15 and 16, brackets 205,206 and 207 are carried by the sleeve 208 which is pivotally mounted about the pivot shaft 209 extending upwardly from the flanged support 181 carried on the base 180. Each bracket 205,206,207 supports a proximity switch 215 on the outer end thereof, with the probe 216 of each proximity switch 215 disposed at a different vertical height above the support table 14. The vertical height of each probe 216 of the proximity switches 215 is not only different from each other, but also is different from the vertical heights of the probes 190 of the proximity switches 189 on turret 26.

A bracket 211 (FIG. 15) is carried by the support 181 and supports a pair of horizontally spaced apart proximity switches 212 with the probes of the proximity switches 212 in alignment with the path of movement of the bar 200 and rod 201.

Figure 17:
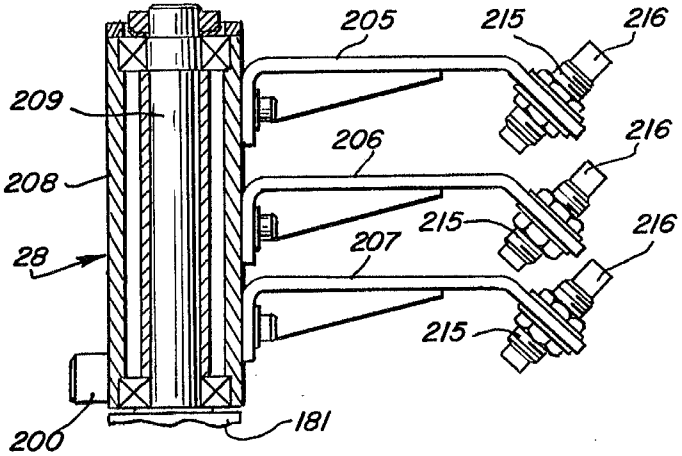
FIG. 17 is a cross-sectional view taken on the line 17–17 of FIG. 15.

As shown in FIGS. 15 and 17, the turret 28 is in the inoperative position, with the rod 201 drawn into the actuator 202 so that the sleeve 208 is in its counterclockwisemost position to hold the proximity switches 215 on the brackets 205,206,207 out of the path of travel of a flag plug 220 on the body being wrapped.

In the at rest condition of the apparatus 10, both turrets 26 and 28 will be in the retracted position with the proximity switches 189 on turret 26 and proximity switches 215 on turret 28 out of the path of movement of a body and specifically flag plug 220 on the carrier rollers 23,24. This will facilitate removing a completed body 11 and loading an unwrapped body to the carrier rollers 23,24.

When the control unit is fed a body size, a signal from the control unit to a control will activate either actuator 194 or actuator 202 to pivot the appropriate turret 26 or 28 into position. It will be assumed that turret 26 has the required proximity switch 189 for the body size being wrapped. Under that circumstance, the signal from the control unit actuates the actuator 194 to retract the rod 193 which will pivot the sleeve 184 in a counterclockwise direction to move the brackets 186,187,188 into the operative position (as shown in FIG. 15) for locating the proximity switches 189 in proximity to the path of the sweep of the flag plugs 220 on the body on the carrier rollers 23,24. When the signal from the control unit activates the actuator 194, the left-hand proximity switch 198 will be actuated so that when the bracket 192 moves under the proximity switch 198, it will signal the control unit to stop the actuator 194 and to hold the proximity switches 189 in the path of travel of the flag plug 220 on the body.

It should be noted that rod 193 is retracted into actuator 194 to pivot the turret 26 into the active position for the proximity switches 189, while retracting the rod 201 into actuator 202, pivots the turret 28 to remove the proximity switches 215 from the path of travel of the flag plugs 220.

As shown in FIG. 16, turret 26 is in the active position with bracket 187 holding one probe 190 of proximity switch 189 in the path of movement but will not contact the flag plug 220 carried by the body. In practice, the flag plug 220 will move into close proximity to the actuated proximity switch, i.e. 189, which will signal the control unit to start the shuttle 15 rotating around the body as the body rotates through the shuttle. A second flag plug 220 on the body will move past the actuated proximity switch 189 after the body has been half wrapped. The second flag plug will send a signal to the control unit, to precondition the control unit for shutdown. The shuttle 15 will continue to wrap the body until the initial flag plug 220 reaches the actuated proximity switch 189 which will initiate shutdown of the rotation of the shuttle 15 and shutdown of the drive roller device 22.

Industrial Applicability

A toroidal body of a predetermined diameter and cross-sectional configuration is lowered into position on the carrier rollers 23,24, the door 34 of the cabinet 12 is then closed and the operator will activate a control unit by inserting the body size information therein. The control unit will signal the controls to activate the motor 40 and to actuate one of the proximity switches 47, whereupon the motor 40 will raise the support table 14, carrier rollers 23,24 and the body 11 until the ferrous bar 48 aligns with the actuated proximity switch 47 which will signal the control unit to signal the motor 40 to stop the motor 40, whereupon the magnetic brake 45 will lock the support table 14 in the raised position. In this position, the mid-circumferential plane of the body 11 will pass through the geometric center "A" of the shuttle 15.

Simultaneously with the signaling of the controls for the motor 40, the control unit will signal the controls for actuating the actuators 106 which will move the idler rollers 118,118 of the idler roller devices 18,20 forward with the block or carriage 103 passing the proximity switch 131' to transmit a "condition accomplished" signal to the controls. The actuator 125 will pivot the idler rollers 118,118 into the position, whereupon the proximity switches 128 on the idler roller devices 18,20 will signal completion of the movement of the idler rollers 118,118 toward the body. The drive roller device 22 is actuated by a signal from the control unit to the controls for actuating the actuator 159 to pivot the centering and driving roller 151 into contact with the body. Actuator 159 will urge the drive roller 151 against the body to shift the body on the carrier rollers 23, 24 into three-point contact with the two idler rollers 118,118. The control unit will signal the motor 144 to rotate the drive roller 151 and, therefore, to rotate the body about the rotational axis B,B' thereof.

Substantially simultaneously with the closing of the door 34, the control unit will signal the controls for actuators 84 and 88 and will actuate one of the proximity switches 98. The actuators 84, 88 will selectively elongate until the vertical axis of the axle 60 reaches the desired location at which point the tip 92 will align with the actuated switch 98 to signal the control unit that the desired position has been reached. In the desired position, the vertical axis of the axle 60 will coincide with the rotational axis B,B' of the body 11 on the carrier rollers 23,24. As the axle 60 is moved, the axes of the carrier rollers 23,24 will be re-oriented so that the longitudinal axis of each carrier roller 23,24 will lie on a radius passing through the rotational axis B,B' of the body 11.

Based on the body size, the control unit will select either turret 26, or turret 28, as the appropriate turret to be moved into position relative to the body, whereupon the control unit will signal the control to actuate actuator 194, or actuator 202, which will pivot the selected turret (in FIG. 15 it is turret 26 that is pivoted) so as to swing the brackets on the selected turret in the path of movement but not in position to be contacted by flag plugs 220 on the body (in FIG. 15 the brackets 186,187, 188 on turret 26 are swung so as to align one proximity switch 189 on one of the brackets 187 with the path of movement but not in contact with flag plug 220 on the body). When the selected turret is in position, the proximity switch 198, or 212, will signal the control unit that the turret is in position. Instead of turret 26, it may be that turret 28 will be activated, whereupon turret 26 will remain in the retracted at rest position.

The drive roller 151 rotates the body about the rotational axis of the body on the carrier rollers 23,24 until a flag plug 220 on the body aligns with the appropriate actuated proximity switch 189 or 215 (in FIG. 15 the switch is 189 on turret 26) as the flag plug 220 sweeps past the proximity switch. This will signal the control unit to signal the controls to activate rotation of the shuttle 15 to start winding of an elongate material on the body. A second flag plug 220 on the body, spaced 180° from the first flag plug 220, will align with the same actuated proximity switch 189 as the plug passes the switch. This will precondition the control unit to be ready for shutdown when the initial flag plug 220 aligns with the first proximity switch 189; whereupon the control unit will signal the controls to stop rotation of the shuttle 15 and to stop rotation of the body. The control unit will now signal the controls (1) to actuate the actuator 159 to retract the drive roller 151 out of position, (2) to actuate the actuators 106 and 125 of the idler rollers 18,20 to pivot and retract idler rollers 118,118 out of position, (3) to actuate actuator 194 or 202 to pivot the turret and proximity switches 189 or 215 out of position, and (4) to actuate the controls to actuate motor 40 to lower the support table 14, carrier rollers 23,24 and the body 11 to the lowermost position. All of which positions are the at rest positions.

The wrapped body can be removed and another unwrapped body placed on the carrier rollers 23,24, ready for starting a new cycle. Body removal and replacement can be done automatically or may be done after the door 34 is opened.

Other aspects, objects and advantages of this invention can be obtained from a study of the drawings, the disclosure and the appended claims.

I claim:

1. An apparatus (10) for positioning and for rotating a toroidal body (11) relative to a shuttle (15), said apparatus (10) having a frame (19) and a support table (14) on said frame (19), the shuttle (15) being carried by said frame (19) and rotatable in a plane lying substantially transverse to said support table (14), comprising:

carrier roller means (23,24) for supporting a toroidal body (11) for rotation relative to said support table (14) about a rotational axis (B,B') of the toroidal body (11); said carrier roller means (23,24) being mounted on said support table (14) and having longitudinal axes radiating generally from said rotational axis (B,B');

means (17) for locating the rotational axis (B,B') of the toroidal body (11) relative to a rotational center (A) of said shuttle (15) and for centering a cross section of the toroidal body (11) within the shuttle (15);

means (22) for rotating the toroidal body (11) through the shuttle (15); and means (106,125,159) for selectively moving said locating means (17) between a plurality of positions accommodating toroidal bodies of different diameters.

2. An apparatus as claimed in claim 1 wherein said means (17) for locating said rotational axis (B,B') includes a pair of idler roller devices (18,20) having idler rollers (118,118) for contacting said body at spaced apart points, and a drive roller device (22) having a drive roller (151) contacting the body at a point spaced from said spaced apart points.

3. An apparatus as claimed in claim 2 wherein said moving means includes means (106,125) for radially and pivotally moving said idler rollers (118) from an at rest position to a predetermined position, and wherein said drive roller device (22) includes said drive roller (151), means (159) for moving said drive roller (151) into contact with said body, and motor means (144) for rotating said drive roller (151) for rotating said body.

4. An apparatus (10) for positioning and for rotating a toroidal body (11) relative to a shuttle (15), said apparatus (10) having a frame (19) and a support table (14) on said frame (19), the shuttle (15) being carried by said frame (19) and rotatable in a plane lying substantially transverse to said suppport table (14), comprising:

carrier roller means (23,24) for supporting a toroidal body (11) for rotation relative to said support table (14) about a rotational axis (B,B') of the toroidal body (11);

means (17) for locating the rotational axis (B,B') of the toroidal body (11) relative to a rotational center (A) of said shuttle (15) and for centering a cross section of the toroidal body (11) within the shuttle (15);

means (22) for rotating the toroidal body (11) through the shuttle (15);

means (106,125,159) for selectively moving said locating means (17) between a plurality of positions accommodating toroidal bodies of different diameters; and height adjusting means (16) for raising and lowering said support table (14) to intersect a mid-circumferential plane of the body with said rotational center (A) of said shuttle (15).

5. An appparatus as claimed in claim 4 wherein said support table (14) has pivot means (30) for pivotally mounting one side of said support table (14) to said frame (19), and wherein said height adjusting means (16) includes a pair of spaced apart actuator means (35) extending between the frame (19) and another side of said support table (14), and means (40) for driving said actuator means (35) for raising said another side of said support table (14).

6. An apparatus (10) for positioning and for rotating a toroidal body (11) relative to a shuttle (15), said apparatus (10) having a frame (19) and a support table (14) on said frame (19), the shuttle (15) being carried by said framme (19) and rotatable in a plane lying substantially transverse to said support table (14), comprising:

carrier roller means (23,24) for supporting a toroidal body (11) for rotation relative to said support table (14) about a rotational axis (B,B') of the toroidal body (11);

means (17) for locating the rotational axis (B,B') of the toroidal body (11) relative to a rotational center (A) of said shuttle (15) and for centering a cross section of the toroidal body (11) within the shuttle (15);

means (22) for rotating the toroidal body (11) through the shuttle (15);

mmeans (106,125,159) for selectively moving said locating means (17) between a plurality of positions accommodating toroidal bodies of different diameters; and means (25) for starting and stopping the rotation of said shuttle (15) about said body, said means (25) being provided on said support table (14) and being responsive to the rotation of said body.

7. An apparatus as claimed in claim 6 wherein said means (25) for starting and stopping rotation includes a pair of turrets (26,28) pivoted on said support table (14), plural brackets (186,187,188,205,206,207) carried by said turrets (26,28) with each bracket supporting a proximity switch (189,215) at a different vertical height from the other of said proximity switches (189,215) and means (194,202) for pivoting only one of said turrets (26,28) into position to align one proximity switch (189,215) for actuation by a flag (220) carried by said body.

8. An apparatus (10) for positioning and for rotating a toroidal body (11) relative to a shuttle (15), said apparatus (10) having a frame (19) and a support table (14) on said frame (19), the shuttle (15) being carried by said frame (19) and rotatable in a plane lying substantially transverse to said support table (14), comprising:

carrier roller means (23,24) for supporting a toroidal body (11) for rotation relative to said support table (14) about a rotational axis (B,B') of the toroidal body (11); said carrier roller means (23,24) includes a plurality of carrier rollers (23,24), each carrier roller (23,24) having a longitudinal axis;

means (21) for orienting the carrier rollers (23,24) with the longitudinal axis of each intersecting with said rotational axis (B,B') of said body;

means (17) for locating the rotational axis (B,B') of the toroidal body (11) relative to a rotational center (A) of said shuttle (15) and for centering a cross section of the toroidal body (11) within the shuttle (15);

means (22) for rotating the toroidal body (11) through the shuttle (15);

means (106,125,159) for selectively moving said locating means (17) between a plurality of positions accommodating toroidal bodies of different diameters.

9. An apparatus as claimed in claim 8 wherein said means (21) for orienting said carrier rollers (23,24) includes actuator means (84,88) carried by said support table (14).

10. An apparatus as claimed in claim 9 wherein bracket means (70) for supporting each said carrier roller (23,24), said bracket means (70) being carried by said support table (14), an axle (60) carried by said support table (14) and having a vertical axis, means (67,69) for connecting each said bracket means (70) with said axle (60), said actuator means (84,88) moving said axle (60) to reposition the vertical axis of the axle (60) to coincide with the rotational axis (B,B') of the body and to simultaneously re-orient the longitudinal axis of each carrier roller (23,24) to pass through said rotational axis (B,B') of the body and the vertical axis of the axle (60).

11. An apparatus as claimed in claim 10 wherein said actuator means (84,88) comprise a pair of tandom-mounted actuator means (84,88) with one end of one actuator means (88) being fixed on said support table (14), the opposite end of the other actuator means (84) being connected to said axle (60), said actuator means (84,88) combining to move said axle (60) to reposition said vertical axis of the axle (60) to coincide with the rotational axis (B,B') of the body and to re-orient the longitudinal axes of the carrier rollers (23,24).

12. An apparatus (10) for positioning and rotating a body, said apparatus (10) having a frame (19), a support table (14) on said frame (19), a shuttle (15) having a plane lying transverse to the support table (14) and being rotatable about said body for applying a material to said body, comprising:

roller means (23,24) for supporting said body for rotation relative to said support table (14) about a rotational axis (B,B') of said body extending transverse to a mid-circumferential plane of said body, height adjusting means (16) for raising and lowering said support table (14) to intersect said mid-circumferential plane of the body with a rotational center (A) of said shuttle (15), drive means (22) for rotating said body in said mid-circumferential plane, and means (25) for initiating the starting and the stopping of the rotation of said shuttle (15) about said body.

13. An apparatus as claimed in claim 12 including centering means (17) for centering said body on said support table (14), said centering means being carried by the support table (14) and being moved into contact with said body to center said body on said support table (14), said drive means (22) and one of said centering means (17) being one in the same, and the remainder of said centering means (17) being a pair of idler roller devices (18,20) engaging the body at points spaced from each other and spaced from the drive means (22).

14. An apparatus as claimed in claim 13 wherein each said idler roller device (18,20) includes an idler roller (118) and means (106,125) for radially and pivotally moving said idler roller (118) from an at rest position into contact with said body, and wherein said drive means (22) includes a drive roller (151), means (159) for moving said drive roller (151) into contact with said body, and motor means (144) for rotating said drive roller (151) for rotating said body.

15. An apparatus as claimed in claim 12 wherein said roller means (23,24) includes a plurality of carrier rollers (23,24) freely rotatable about longitudinal axes of said rollers (23,24), bracket means (70) for supporting said carrier rollers (23,24) an axle (60) carried by said support table (14) and having a vertical axis, means (63,67,69) for connecting said bracket means (70) with said axle (60), and means (84,88) for moving said axle means (60) for aligning the longitudinal axes of said carrier rollers (23,24) to pass through the vertical axis of said axle and to align said vertical axis of the axle with the rotational axis (B,B′) of said body.

16. An apparatus as claimed in claim 15 wherein said last-named means (84,88) comprises a pair of tandom-mounted actuator means (84,88) with one end of one actuator means (88) being fixed on said support table (14), the opposite end of one actuator means (88) being connected to one end of the other actuator means (84), the opposite end of the other actuator means (84) being connected to said axle (60), said actuator means (84,88) combining to move said axle (60).

17. An apparatus as claimed in claim 12 wherein said means (25) for initiating starting and stopping rotation of the shuttle (15) includes a pair of turrets (26,28) pivoted on said support table (14), plural brackets (186,187,188,205,206,207) carried by said turrets (26,28) with each bracket supporting a proximity switch (189,215) at a different vertical height from the other proximity switches (189,215), and means (194,202) for pivoting only one of said turrets (26,28) into position to align one proximity switch for alignment with a flag (220) on said body as said body is rotated.

18. A toroidal body positioning and driving apparatus having a frame (19), a support table (14) on said frame (19), said body being carried by said support table (14) for rotation about a rotational axis (B,B′) extending transverse to a mid-circumferential plane of said body, a shuttle (15) having a plane lying transverse to the plane of said body and being rotatable about said rotatable body for applying a material in a spiral configuration on said body, roller means (23,24) for rotatably supporting said body relative to said support table (14), height adjusting means (16) for raising and lowering said support table (14) to pass said mid-circumferential plane of the body substantially through a rotational center of said shuttle (15), centering means (17) for centering said body relative to said support table (14), said centering means (17) including a drive means (22) for rotating said body in said mid-circumferential plane, and means (25) for pivoting a proximity switch (189,215) into position to be passed by a flag (220) carried by said rotatable body for starting and stopping the rotation of said shuttle (15) about said body.

19. An apparatus as claimed in claim 18 wherein said roller means (23,24) includes a plurality of elongate carrier rollers (23,24) freely rotatable about their longitudinal axes, bracket means (70) for supporting said carrier rollers (23,24), said bracket means being carried by said support table (14), axle means (60) for aligning said longitudinal axes of said carrier rollers (23,24), said axle means (60) being carried by said support table (14) and having a vertical axis, means (63,67,69) for adjustably connecting said axle means (60) to said bracket means (70) for aligning said longitudinal axes of said carrier rollers (23,24) to pass through the vertical axis of said axle means (60), and means for moving said axle means (60) to align the vertical axis of the axle means (60) with the rotational axis (B,B′) of the body and to simultaneously align the longitudinal axes of said carrier rollers (23,24) with said rotational axis (B,B′).

20. In an apparatus as claimed in claim 18 including actuator means (84,88) for adjusting the location of the intersection of the longitudinal axes of said roller means (23,24) to coincide with the rotational axis (B,B′) of said body, said actuator means (84,88) being carried by said support table (14).

21. In an apparatus as claimed in claim 20 wherein said actuator means (84,88) comprises a pair of tandom-mounted actuators (84,88) with one end of one actuator (88) being fixed on said support table (14), the opposite end of the other actuator (84) being connected to an axle (60) having a vertical axis which forms the intersection of the longitudinal axes of said carrier rollers (23,24), said actuators (84,88) combining to move said axle (60) to a predetermined location to coincide the vertical axis of the axle (60) with the rotational axis (B,B′) of said body.

* * * * *